US005163485A

United States Patent [19]

Hermann

[11] Patent Number: 5,163,485

[45] Date of Patent: Nov. 17, 1992

[54] CONTAINER ASSEMBLY FOR FLOWABLE MATERIALS

[75] Inventor: Francis Hermann, Drulingen, France

[73] Assignee: Sotralentz S.A., Drulingen, France

[21] Appl. No.: 633,484

[22] Filed: Dec. 27, 1990

[30] Foreign Application Priority Data

Jan. 11, 1990 [DE] Fed. Rep. of Germany ..... 4000652

[51] Int. Cl.[5] ..... B65B 1/04; B65B 3/16

[52] U.S. Cl. ..... 141/10; 141/114; 53/260; 222/105; 222/183

[58] Field of Search ..... 141/10, 4, 7, 8, 114, 141/2, 263; 220/403, 404; 53/255, 260; 222/105, 183

[56] References Cited

U.S. PATENT DOCUMENTS

| | | | |
|---|---|---|---|
| 2,087,157 | 7/1937 | Lind | 141/10 |
| 3,129,747 | 4/1964 | Warner | 220/403 |
| 3,167,209 | 1/1965 | Jones | 220/403 |
| 4,256,150 | 3/1981 | Möckesch | 141/10 |
| 4,386,634 | 6/1983 | Stasz et al. | 141/10 |
| 4,516,692 | 5/1985 | Croley | 222/105 |
| 4,924,919 | 5/1990 | Oyler | 141/8 |

*Primary Examiner*—Henry J. Recla
*Assistant Examiner*—David J. Walczak
*Attorney, Agent, or Firm*—Herbert Dubno

[57] ABSTRACT

A container assembly for liquids and bulk solids has a bladder within a supporting container provided with a filling control element surrounding a folded constricting portion of the bladder. As filling continues, this element rises to liberate folded parts of the bladder forming the constricting strip portion and thereby insures a uniform application of the bladder to the interior surfaces of the supporting outer container.

8 Claims, 3 Drawing Sheets

CONTAINER ASSEMBLY FOR FLOWABLE MATERIALS

FIELD OF THE INVENTION

Our present invention relates to a container assembly for the storage and transportation of flowable materials, for example, liquids or pulverulent bulk materials. The invention also relates to a packaging method whereby such flowable materials can be transported and/or stored.

BACKGROUND OF THE INVENTION

For large scale storage, transportation and dispensing of flowable materials such as liquids and pulverulent solid bulk materials, as well as of gases, it is known to provide a container assembly which comprises an outer supporting container and a plastic foil or film liner which can originally be in a flaccid condition and can be expanded by the introduction of the flowable materials into this bladder.

The outer container can have a pipe fitting to which a cover or valve or cock is connected and the bladder may have a tubular portion which can extend through this fitting and can be applied to an outer edge thereof to provide communication from the interior of the bladder to the exterior of the container.

The container can have an opening at the upper end through which the bladder can be inserted and filled if desired. The opening in turn can be closed by a cover.

In general, such container assemblies are intended to hold relatively large volumes. For example, the capacity of such a container can be 1000 liters or more (see German Patent Document DE-GM 88 07 118). The foil bladder allows the outer container to be reused without the need to clean the outer container simply by replacement of the bladder. The bladder can be disposable. For example, the material contained in the bladder may be an environmentally hazardous method and any residues can remain in the bladder for disposable and the outer container can be reused by the insertion of a new foil or film bladder.

In such cases it is not necessary to engage in expensive or time-consuming procedures to clean the interior of the outer container or to decontaminate it. It will be self-understood for such purposes that the foil bladder which must receive the liquid or pulverulent flowable material, should not be penetrable or easily damaged. In fact, when the foil bladder is filled, it is already within the outer container and thus fully supported.

In the container assembly described in German Patent Document DE-OS 22 55 299, the outer container is a barrel or drum. The inner container is provided as a bag which is inserted into the drum and is connected to the bung in the barrel top. Problems are encountered with such systems when the wall of the inserted bag is not connected with the inner wall of the barrel.

There is a danger that the bag will tear away from the bung opening and discharge its contents into the interior of the barrel.

In a system of another type, a folded container has a throughgoing opening for the outlet tube of an inner bag (see German Patent Document DE-AS 12 78 335). In this case, the inner bag has an outlet fitting which is arranged at an upper portion of the folded container and passes through the throughgoing opening of the latter at this upper region. It can also be jammed and torn.

With the container assemblies which have been described there is the further problem that the foil bladder does not always lie smoothly along the inner wall of the outer container but can form uncontrollable folds which lie against the inner wall of the outer vessel and are locked in place under the pressure of the filling material. This can result in stress upon the foil bladder which, in conjunction with vibrations and oscillations of the mass within the assembly during transport by road, rail or ship, give rise to leaks.

OBJECTS OF THE INVENTION

It is the principal object of the present invention, therefore, to provide a container assembly for the purposes described, i.e. for the large volume storage and transportation of liquids and other bulk flowable materials, whereby the drawbacks of these earlier systems are avoided.

Still another object of the invention is to provide a container assembly which reduces the possibility of fold formation of the foil bladder during filling and, therefore, reduces the possibility of leaks resulting from this problem.

SUMMARY OF THE INVENTION

These objects and others which will become apparent hereinafter are attained, in accordance with the present invention in a container assembly for receiving a flowable material which comprises:

an outer supporting container formed with a container wall, a container bottom, a container top, an outlet pipe fitting on the wall in a region thereof close to the bottom, and means forming an opening of larger diameter than the pipe fitting in the container top, the fitting being formed with an external screwthread adapted to accommodate a valve or cover for the fitting;

an inner flexible foil bladder in the container formed with a tubular portion extending through the fitting and adapted to be applied to an outer edge thereof, the foil bladder being gatherable at least in part upon removal of air therefrom and insertable in the container through the opening and having a gatherable bottom portion adapted to rest upon the bottom of the container, a strip portion extending upwardly from the bottom portion through the opening, and a free end above the strip portion; and a filling control element peripherally surrounding the strip portion over at least a portion of a length thereof and moving progressively upwardly in the container as the bladder is filled with the flowable material.

The invention also comprises a method of packaging the liquid-gaseous or pulverulent solid flowable materials which comprises the steps of:

expressing air from a flaccid bladder and enclosing a strip portion thereof in a filling control element peripherally surrounding the strip and maintaining same in an elongated configuration;

inserting the bladder, utilizing the filling control element to manipulate it, into a supporting container through an opening in a top thereof, so that the bladder has a flaccid bottom portion lying on a bottom of the container, the strip portion extending upwardly in the container through the opening and a free end above the filling control element;

inserting a filling tube through the free end and the strip portion into the bottom portion and filling the bladder through the tube; and controlling filling of the bladder with the flowable material by progressively raising at least a lower part of the filling control element.

It will be understood, of course, that the formation of the strip portion of the flaccid bladder should be effected without applying torsion to the constricted portion or so that only a minimum torsion is applied and access to the bottom portion is not prevented by twisting off a neck of the bladder and so that, during filling, the strip portion will readily unfold.

Because the strip portion of the bladder is initially constricted or drawn together and the filling control element at least at its lower portion rises progressively with filling, the wall of the bladder comes to lie progressively against the wall of the supporting container and free folds of the bladder are not available to become locked in by the pressure of the filling material. There is a progressive and smooth application, therefore, of the bladder against the wall of the outer container and any loose material remains confined by the filling control element until filling has advanced sufficiently to press the filling control element upwardly. The strip portion is thereupon progressively liberated upwardly to be spread outwardly against the wall of the outer container.

While folds are present in the strip portion as long as the strip portion remains confined by the filling control element, these folds are only temporary and do not become fixed by the weight of the material.

The filling control element thus actually controls the filling operation so that it will be an overall smooth application of the foil bladder against the inner wall of the outer container until the bladder is completely filled or until the desired degree of filling is attained.

According to the invention, the flowable material can be introduced directly into the flaccid bladder or, in accordance with another embodiment of the invention, a gaseous medium such as air can be forced into the flaccid bladder to apply the bladder against the wall of the outer container, whereupon a liquid or pulverulent flowable material can be introduced to displace the gaseous medium.

According to a feature of the invention, the filling control element is a ring which is preferably elastically deformable.

In a preferred embodiment of the invention, however, the filling control element is a rollable sleeve of rubber or plastic which can be rolled up from its bottom upwardly and can evert as it is rolled up to form the progressive rise of the lower portion of the filling control element.

The rollable sleeve can be constituted of a thin rubber skin or foil or from a plastic foil which permits the rolling action which has been described.

The rollable sleeve can extend over practically the entire length of the striplike gathered region of the bladder and retains the gather which forms the striplike region. The filling of the container assembly can be comparatively simple since it is possible to effect the filling through a filling tube which is inserted through the strip portion into the bottom portion of the bladder. The rollable sleeve can be affixed on a collar of the large diameter opening at the top of the outer container. In general, the filling process is carried out in such manner that a portion, i.e. the aforementioned free end, of the foil bladder lies above the filling control element in a nongathered but flaccid condition.

By and large it has been found to be advantageously to supply the container with the bladder in place and, if desired, fixed by auxiliary elements at the large diameter container opening.

However, in the case of multiple use outer containers, the foil bladder is inserted in the outer container only immediately before filling thereof by the uses of the container. It has been found, therefore, that the bladder must be manipulated into the outer container in a convenient manner and that the filling control element greatly facilitates this manipulation, acting as a kind of handle for positioning and inserting the bladder in the container.

The outer container can have a wall thickness sufficient to provide the necessary support for the foil bladder and can, if desired, be surrounded by a jacket which provides structural support and protection, e.g. of a wire or rod grate or mesh, for example, of steel.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
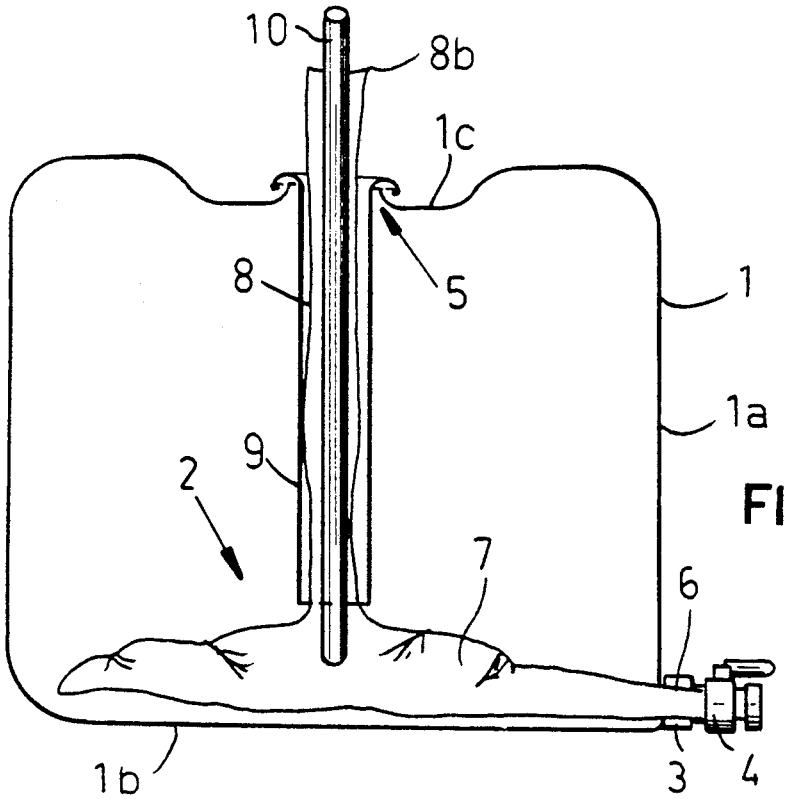
FIG. 1 is a highly diagrammatic vertical cross sectional view of the container assembly of the invention prior to the filling of the flowable material into the latter.

The container assembly illustrated in the drawing serves to receive a liquid or pulverulent flowable material which is to be stored and/or transported in the container assembly.

Basically, the container assembly comprises a load-supporting outer container 1 and a foil or film bladder 2 composed of a synthetic resin or plastic and inert with respect to the filling material. The bladder 2 is located in the interior of the outer container 1 and is shaped and dimensioned so that it, upon filling with the flowable material, can conform to the contours of the inner wall of the outer container 1.

Figure 5:
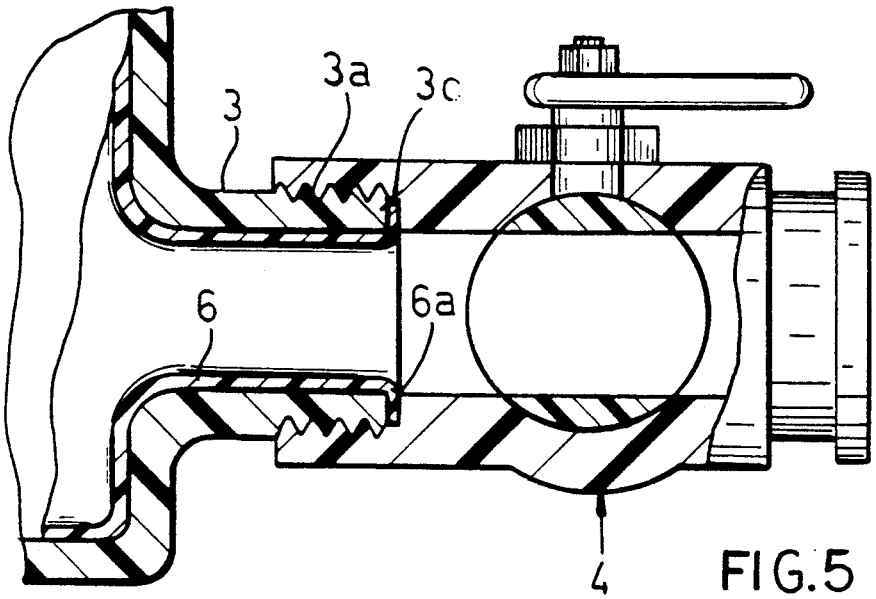
FIG. 5 is a cross sectional view of the valve, fitting structure.
Figure 6:
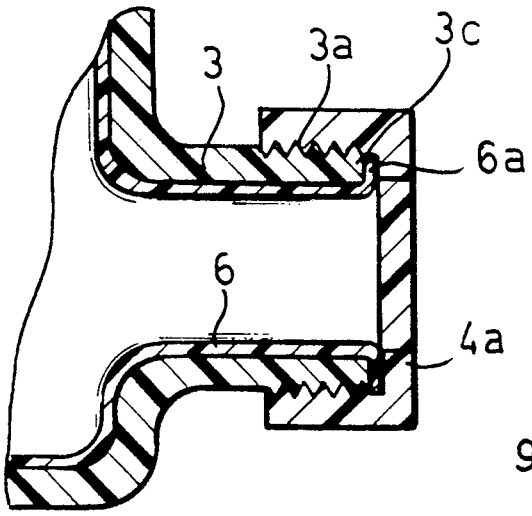
FIG. 6 is a cross sectional view illustrating a detail of the system in which a cover is applied to the fitting.

The outer container 1 comprises in its wall 1*a* close to the bottom 1*b* an outlet pipe fitting having an external thread 3*a* as best seen in FIGS. 5 and 6. The outer thread serves to connect a valve or cock 4 to the fitting as can be seen from FIG. 5 or to connect a cap or cover 4*a* to the fitting. Either the cap or the valve holds an end portion 6*a* of a tubular portion 6 of the bladder against the edge 3*c* of the fitting 3. The valve 4 can be operated to close off the outlet or to control the flow of the contents of the container therefrom.

Figure 3:
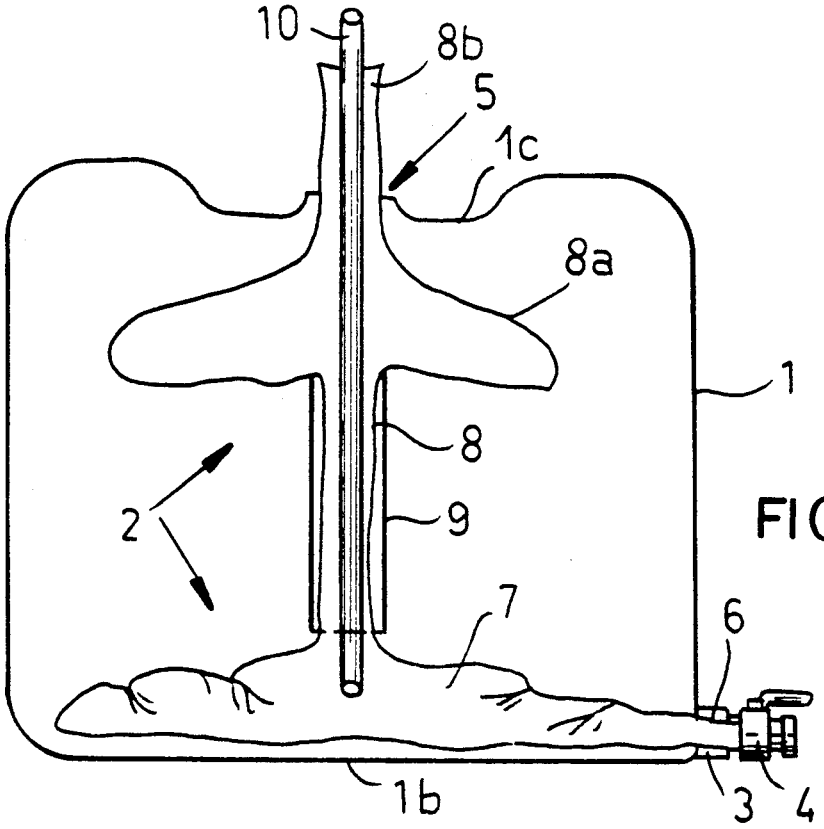
FIG. 3 is a view similar to FIG. 1 of a container assembly according to another embodiment of the invention.

From FIGS. 1 and 3 it will be apparent that the bladder 2 can be inserted into the outer container after air has been expressed therefrom in a relatively flaccid state so that a bottom portion 7 rests upon the bottom 1*b* of the container. The remainder of the bladder forms a strip region 8 extending upwardly through the opening 5 in the top 1*c* of the outer container or extending to another flaccid region 8*a* of the bladder above the strip region, as largely as possible without twisting. In the embodiment of FIG. 1, the strip portion 8 extends fully from the container whereas in FIG. 3 the strip portion terminates below the opening 5 in the top of the container and a free end 8*b* extends out of the container. Over at least a portion of its length above the gathered between portion 7, the strip portion 8 is surrounded by a filling control element 9. At least the lower end of this filling control element is movable upwardly as the bladder is filled with a gaseous medium or with a liquid or flowable solid medium which is introduced through a tube reaching downwardly through the strip portion into the bottom portion 7.

As can be seen from FIG. 1, the clearance between the element 9 and the edge of opening 5 and the clearance between the strip portion 8 and the element 9 permit air to escape from the container as the bladder is filled.

Figure 2:
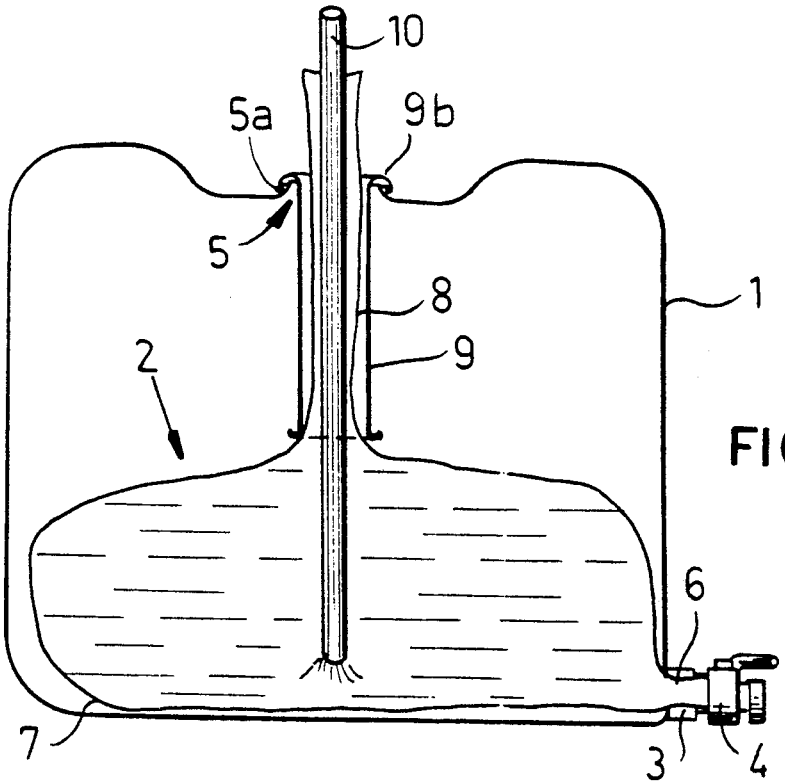
FIG. 2 is a similar view of the container assembly of FIG. 1, partly filled.
Figure 4:
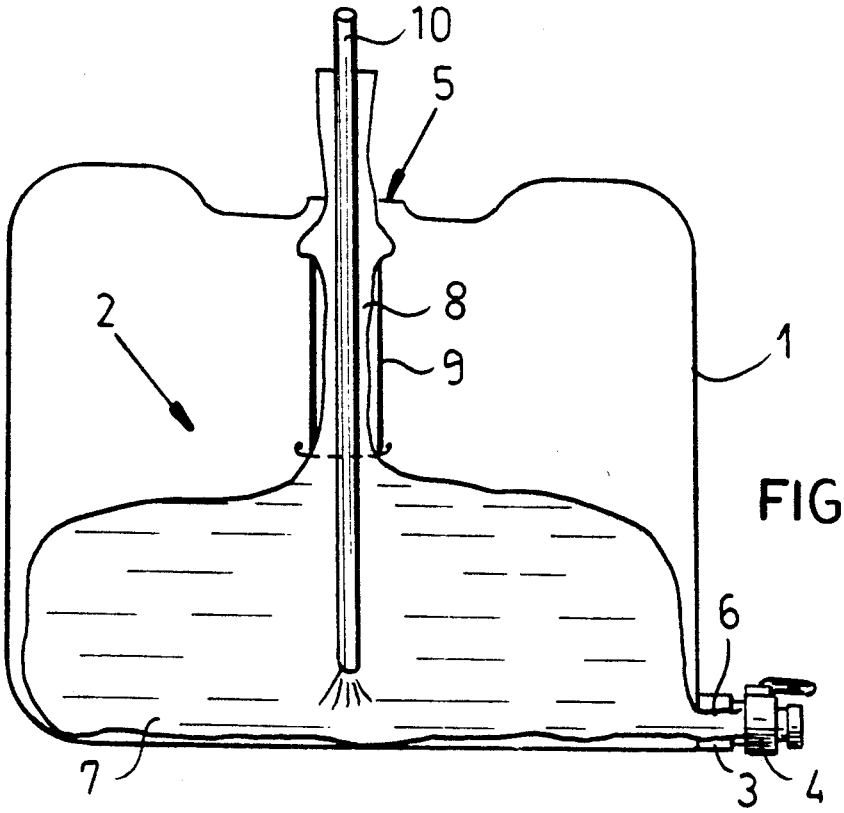
FIG. 4 is a view similar to FIG. 2 of this second embodiment.
Figure 7:
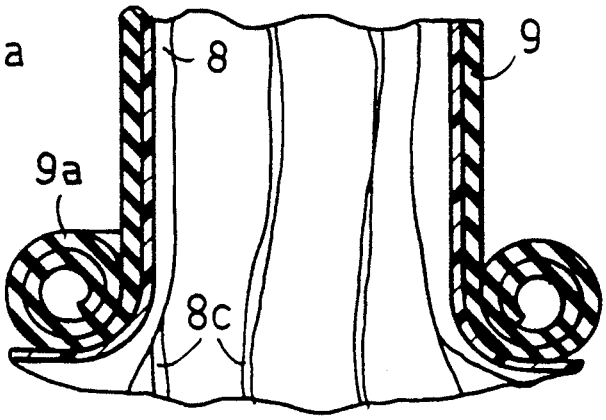
FIG. 7 is a detailed view of a portion of the strip part of the bladder showing the rolling of the lower end of the sleeve constituting the flow control element.

As a comparison of FIGS. 2 and 4, respectively, with FIGS. 1 and 3 will show, initially the bottom portion 7 is filled, generally more or less suddenly to rapidly place the bladder below the filling control sleeve 9 against the inner wall of the outer container. As filling continues, the bottom portion of the sleeve 9 is rolled up at 9*a* (see FIG. 7) to permit the folds 8*c* in the strip to spread out. Thus the folds of the strip portion are temporary and are spread depending upon the degree of filling.

The rollable sleeve 9 can be composed of rubber or plastic and can roll substantially to the upper end of the sleeve. At the upper end, a portion 9*b* of the sleeve 9 is turned over the collar 5*a* surrounding the opening 5 to hold the sleeve 9 in place in the embodiment of FIGS. 1 and 2.

A portion of the bladder 2 can lie above the sleeve 9 free from constraints. In the completely filled state, the foil bladder lies uniformly over all of the interior surface of the outer container 1.

I claim:

1. A container assembly for receiving a flowable material, comprising:

an outer supporting container formed with a container wall, a container bottom, a container top, an outlet pipe fitting on said wall in a region thereof close to said bottom, and means forming an opening of larger diameter than said pipe fitting in said container top, said fitting being formed with an external screwthread adapted to accommodate a valve or cover for said fitting;

an inner flexible foil bladder in said container formed with a tubular portion extending through said fitting and adapted to be applied to an outer edge thereof, said foil bladder being gatherable at least in part upon removal of air therefrom and insertable in said container through said opening and having a gatherable bottom portion adapted to rest upon said bottom of said container, a tubular portion extending upwardly from said bottom portion through said opening and terminating in an open free end above said opening; and a filling control element peripherally surrounding said tubular portion over at least a portion of a length thereof and which is adapted to move progressively upwardly in said container as said bladder is filled when said flowable material enters said bladder through said tubular portion.

2. The assembly defined in claim 1 wherein said filling control element is a ring.

3. The assembly defined in claim 2 wherein said ring is an elastically deformable ring.

4. The assembly defined in claim 1 wherein said filling control element is a rollable sleeve capable of everting and composed of rubber or plastic and which at a lower end rolls up as said bladder is filled.

5. The assembly defined in claim 1, further comprising a filling tube inserted through said opening, said free end and said tubular portion into said bottom portion for filling said bladder with said flowable material.

6. The assembly defined in claim 1 wherein a non-tubular portion of said bladder is formed above said filling control element.

7. A method of packaging a flowable material, comprising the steps of:

expressing air from a flaccid bladder and enclosing a tubular portion thereof in a filling control element peripherally surrounding said tubular and maintaining same in an elongated configuration;

inserting said bladder, utilizing said filling control element to manipulate it, into a supporting container through an opening in a top thereof, so that said bladder has a flaccid bottom portion lying on a bottom of said container, said tubular portion extending upwardly in said container through said opening and a free end above said filling control element;

inserting a filling tube through said free end and said tubular portion into said bottom portion and filling said bladder through said tube; and controlling filling of said bladder with said flowable material by progressively raising at least a lower part of said filling control element.

8. The method defined in claim 7 wherein said filling control element is a rollable sleeve of rubber or plastic, and wherein said lower part of said sleeve is raised by rolling said sleeve upwardly with eversion of said sleeve.

* * * * *